US009574515B2

(12) United States Patent
Hegner et al.

(10) Patent No.: US 9,574,515 B2
(45) Date of Patent: Feb. 21, 2017

(54) METHOD FOR OPERATING AN INTERNAL COMBUSTION ENGINE AND CORRESPONDING INTERNAL COMBUSTION ENGINE

(71) Applicant: MTU Friedrichshafen GmbH, Friedrichshafen (DE)

(72) Inventors: Ronald Hegner, Friedrichshafen (DE); Michael Willmann, Bermatingen (DE); Marc Radl, Friedrichshafen (DE)

(73) Assignee: MTU FRIEDRICHSHAFEN GMBH, Friedrichshafen (DE)

( * ) Notice: Subject to any disclaimer, the term of this patent is extended or adjusted under 35 U.S.C. 154(b) by 0 days.

(21) Appl. No.: 14/764,058

(22) PCT Filed: Jan. 23, 2014

(86) PCT No.: PCT/EP2014/000172

§ 371 (c)(1),
(2) Date: Jul. 28, 2015

(87) PCT Pub. No.: WO2014/117921

PCT Pub. Date: Aug. 7, 2014

(65) Prior Publication Data

US 2015/0369163 A1 Dec. 24, 2015

(30) Foreign Application Priority Data

Jan. 29, 2013 (DE) ..... 10 2013 201 410

(51) Int. Cl.
*F02D 41/38* (2006.01)
*F02M 63/00* (2006.01)
(Continued)

(52) U.S. Cl.
CPC ..... *F02D 41/3809* (2013.01); *F02D 41/062* (2013.01); *F02D 41/20* (2013.01);
(Continued)

(58) Field of Classification Search
CPC .... F02D 41/20; F02D 41/062; F02D 41/3809; F02D 41/3017; F02M 63/0015
(Continued)

(56) References Cited

U.S. PATENT DOCUMENTS 4,511,945 A * 4/1985 Nielsen ..... F02D 41/20 123/490
5,090,381 A 2/1992 Tanabe
(Continued)

FOREIGN PATENT DOCUMENTS

DE 4036844 A1 5/1991
DE 10014228 A1 9/2001
(Continued)

*Primary Examiner* — Hieu T Vo
*Assistant Examiner* — Arnold Castro
(74) *Attorney, Agent, or Firm* — Lucas & Mercanti, LLP; Klaus P. Stoffel

(57) ABSTRACT

A method for operating an internal combustion engine having at least one fuel injection valve for introducing fuel into a combustion chamber of the internal combustion engine, the valve being supplied with a specified current intensity in order to adjust a specified flow cross-section of a fuel fluidic connection in the combustion chamber. The maximum specified current intensity during normal operation is equal to a first current intensity and during a release operation is equal to a second, higher current intensity.

12 Claims, 1 Drawing Sheet

(51) Int. Cl.
*F02D 41/30* (2006.01)
*F02D 41/06* (2006.01)
*F02D 41/20* (2006.01)
*F02M 65/00* (2006.01)

(52) U.S. Cl.
CPC ..... *F02D 41/3017* (2013.01); *F02M 63/0015* (2013.01); *F02M 65/008* (2013.01)

(58) Field of Classification Search
USPC ..... 123/478, 490, 472; 631/153, 154, 152, 631/155
See application file for complete search history.

(56) References Cited

U.S. PATENT DOCUMENTS

| | | | | |
|---|---|---|---|---|
| 6,785,112 | B2 | 8/2004 | Reischl et al. | |
| 7,080,624 | B2 | 7/2006 | Britsch et al. | |
| 7,225,075 | B2 | 5/2007 | Joos et al. | |
| 7,497,206 | B2 | 3/2009 | Kemmer | |
| 8,332,125 | B2 | 12/2012 | Boee et al. | |
| 2002/0148448 | A1* | 10/2002 | Stier | F01L 9/04 123/490 |
| 2003/0010325 | A1* | 1/2003 | Reischl | F02D 41/20 123/490 |
| 2004/0040545 | A1* | 3/2004 | Nasu | F02D 41/3836 123/490 |
| 2004/0118384 | A1* | 6/2004 | Oyama | F02D 41/20 123/479 |
| 2007/0157906 | A1* | 7/2007 | Kemmer | F02D 41/20 123/490 |
| 2009/0159047 | A1* | 6/2009 | Eto | F02D 41/20 123/435 |
| 2015/0184626 | A1* | 7/2015 | Denk | F02D 41/2096 123/478 |
| 2015/0377173 | A1* | 12/2015 | Tritsch | F02D 41/20 123/476 |

FOREIGN PATENT DOCUMENTS

| | | | |
|---|---|---|---|
| DE | 10305178 | A1 | 8/2004 |
| DE | 102006016892 | A1 | 10/2007 |
| DE | 102007044400 | B3 | 6/2009 |
| DE | 102009029656 | A1 | 3/2011 |
| EP | 1396630 | A2 | 3/2004 |
| EP | 1834073 | B1 | 6/2009 |
| WO | 03027473 | A1 | 4/2003 |

* cited by examiner

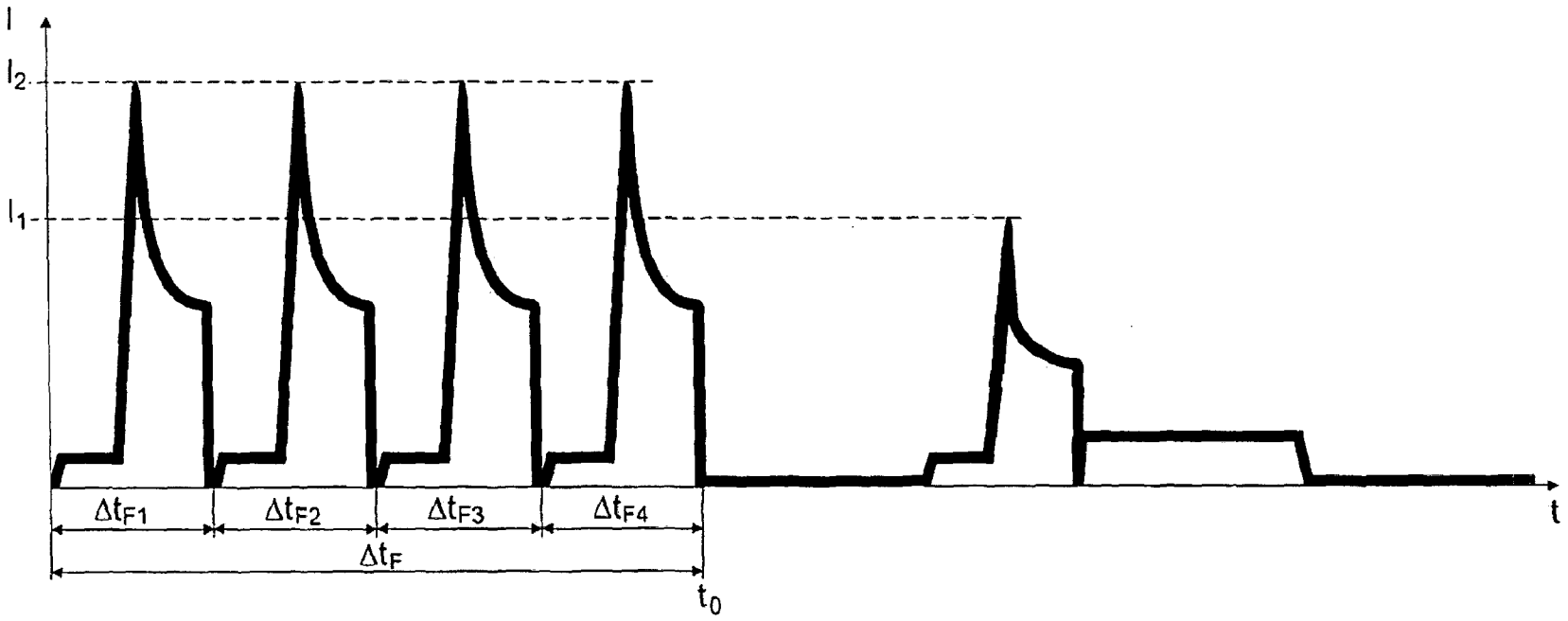
I
I2
I1
ΔtF1
ΔtF2
ΔtF3
ΔtF4
ΔtF
t0
t

METHOD FOR OPERATING AN INTERNAL COMBUSTION ENGINE AND CORRESPONDING INTERNAL COMBUSTION ENGINE

The present application is a 371 of International application PCT/EP2014/000172, filed Jan. 23, 2014, which claims priority of DE 10 2013 201 410.4, filed Jan. 29, 2013, the priority of these applications is hereby claimed and these applications are incorporated herein by reference.

BACKGROUND OF THE INVENTION

The invention relates to a method for operating an internal combustion engine comprising at least one fuel injection valve for introducing fuel into a combustion chamber of the internal combustion engine, which valve is supplied with a specific current intensity using pulse-width modulation, in order to set a specific throughflow cross section of a fuel flow connection into the combustion chamber, wherein the current intensity changes between a minimum value and a maximum value. The invention also relates to an internal combustion engine.

The internal combustion engine can be configured in principle for any desired field of use. For example, it can serve to drive a motor vehicle or a utility vehicle. In particular in the case of internal combustion engines having a large cubic capacity and a large number of cylinders, for example at least eight or twelve cylinders, in particular a use of the internal combustion engine for driving a construction machine, a construction device or the like can be provided. Alternatively, the internal combustion engine can serve to drive a watercraft. The internal combustion engine is preferably a reciprocating piston engine; but of course other designs can also readily be implemented.

Each cylinder of the internal combustion engine is assigned a combustion chamber in which fuel and air, in particular a fuel/air mixture, is introduced during the operation of the internal combustion engine. Combustion of the fuel or of the corresponding mixture takes place subsequently, as a result of which a force is applied to a piston which is movably arranged in the cylinder, and consequently a torque is made available at a crankshaft of the internal combustion engine. The introduction of the fuel into the combustion chamber is carried out by means of the fuel injection valve, which can also be referred to as an injection nozzle. For example, the internal combustion engine has a storage-type injection device, which can also be referred to as a common rail injection device. In this case, the fuel injection valve is assigned to this storage-type injection device, that is to say constitutes in this respect a common rail fuel injection valve or a common rail injector.

In order to open or disconnect the fuel flow connection using the fuel injection valve, that is to say therefore to set the specific throughflow cross section of the fuel flow connection, the fuel injection valve is correspondingly actuated, in particular supplied with the specific current intensity. The actuation can take place by using pulse-width modulation in which the current intensity of the electric current flowing through the fuel injection valve changes between two values, for example between a minimum value and a maximum value. While successive actuation time periods always have the same chronological duration, the throughflow cross section is influenced by the selection of a specific duty factor. The latter indicates the proportion of the actuation time period during which the fuel injection valve is to be supplied with the maximum value of the current intensity, while during the rest of the actuation time period only the minimum value of the current intensity is present at the fuel injection valve. The minimum value is preferably zero.

However, for reasons of design, the fuel injection valve has at least one constriction, in particular in the form of a narrow gap, in the fuel flow connection of the fuel injection valve. In this constriction, particles of dirt can be deposited and coatings can form. These can lead to a malfunction of the fuel injection valve. The cylinder to which the fuel injection valve is assigned does not have any fuel fed to it in this case, or has a smaller amount of fuel fed to it than is provided for. This brings about a drop in power of the internal combustion engine and/or uneven running of the engine. In this case, the fuel injection valve must generally be replaced.

Documents DE 10 2009 029 656 A1 and DE 103 05 178 A1 are known from the prior art. The former document relates to an internal combustion engine comprising at least a first injection valve and a second injection valve, wherein each of the first and second injection valves is configured to carry out a partial stroke or a full stroke, and a control unit which is configured to actuate the injection valves individually, with the result that the first injection valve can be switched over from the partial stroke to the full stroke, in order to carry out a full stroke at least once, wherein in this context the second injection valve remains in the partial stroke. The document mentioned last presents a method for operating an injection valve of an internal combustion engine.

SUMMARY OF THE INVENTION

The object of the invention is therefore to propose a method for operating an internal combustion engine, which method does not have this disadvantage but instead prevents malfunctions and/or adverse effects on the functioning of the fuel injection valve which are caused, in particular, by particles of dirt and coatings.

This is achieved according to the invention with a method in which the specific current intensity is selected to be at maximum equal to a first current intensity during a normal operating mode of the internal combustion engine and equal to a second, relatively high current intensity during a clearing operating mode, wherein the first current intensity is constant during the normal operating mode and corresponds to the maximum value of the current intensity.

The specific current intensity corresponds here preferably to the maximum value of the current intensity which is described above and which is used during actuation of the fuel injection valve by means of pulse-width modulation. During the normal operating mode of the internal combustion engine, which corresponds, in particular, to continuous operation or useful operation of the internal combustion engine, the specific current intensity is selected in such a way that it is at maximum equal to the first current intensity. The first current intensity is selected here, for example, in such a way that even during the continuous operation of the internal combustion engine, that is to say during operation of the internal combustion engine over a relatively long time period, no damage is to be expected to the fuel injection valve, for example as a result of overheating or the like.

The useful operating mode mentioned above corresponds to operation of the internal combustion engine during which the internal combustion engine is used, for example, to drive a working machine or the like. In order to counter the above-mentioned problems of dirt particles or coatings, there is, however, provision of the clearing operating mode in addition to the normal operating mode. During said clearing operating mode the specific current intensity is selected to be equal to the second current intensity, which is higher than the first current intensity. The second current intensity is, for example, at least 5%, at least 10%, at least 15%, at least 20%, at least 25%, at least 30%, at least 40% or at least 50% higher than the first current intensity. In the clearing operating mode, the fuel injection valve is supplied at least once with the specific current intensity which corresponds to the second current intensity.

The fuel flow connection which is adversely affected by the dirt particles or coatings can be cleared by virtue of the relatively high current intensity. This is the case, in particular, if a valve needle which is present in the fuel injection valve and which can be moved by means of a magnetic force in order to set the specific throughflow cross section is blocked by the dirt particles or coatings. The magnetic force which serves to move the valve needle is generated here by the supplying of the fuel injection valve with the specific current intensity. As a result of the selection of the second, relatively high current intensity when the fuel injection valve is supplied, a stronger magnetic force is correspondingly achieved than with the first current intensity. With said relatively strong magnetic force it is possible to release the valve needle, after which satisfactory movement of the valve needle is readily possible with the first current intensity even in the normal operating mode.

The second current intensity is therefore preferably selected in such a way that the fuel flow connection is cleared and the valve needle is released. However, at the same time the second current intensity is selected in such a way that no damage occurs to the fuel injection valve during the clearing operating mode. With such a procedure, the fuel injection valve which is adversely affected by the dirt particles or coatings can be reactivated. Said fuel injection valve therefore has a longer period of use or service life than fuel injection valves which are actuated with known methods in which only the first current intensity is used. The first current intensity and the second current intensity preferably each denote here the maximum current intensity which is present at the fuel injection valve during one of the actuation time periods.

There is provision here that the first current intensity is selected to be constant during the normal operating mode. There is therefore not provision for the first current intensity to be varied during the normal operating mode. This is the case, in particular, when the fuel injection valve is triggered by means of pulse-width modulation, wherein the maximum value of the current intensity for this pulse-width modulation corresponds to the first current intensity in the normal operating mode, and to the second current intensity in the clearing operating mode.

A further refinement of the invention provides that the clearing operating mode is carried out before the normal operating mode, in particular when the internal combustion engine is deactivated. In the normal operating mode, the first current intensity is used as a specific current intensity. Correspondingly, under certain circumstances it may be the case that the fuel injection valve which is adversely affected by the dirt particles or coatings cannot set the specific throughflow cross section when it is supplied with the specific current intensity. For this reason, the clearing operating mode is to be carried out before the normal operating mode. In said clearing operating mode, the fuel injection valve, in particular the valve needle of the fuel injection valve, is "shaken free". Once this shaking free process has taken place, the internal combustion engine can subsequently be operated readily and without adverse effects on the operation in the normal operating mode.

The clearing operating mode particularly preferably takes place when the internal combustion engine is deactivated, that is to say in a state of the internal combustion engine during which combustion is not performed in the combustion chamber and/or the fuel is not present at the operating pressure. In contrast, during the normal operating mode, the combustion of fuel is performed in the combustion chamber. Likewise, said fuel is present at its operating pressure. The advantage of carrying out the clearing operating mode when the internal combustion engine is deactivated is, in particular, that the supplying of the fuel injection valve with the specific current intensity, that is to say with the second current intensity in this case, can be performed as desired, in particular at any desired times and/or with any desired duration, without having to take into account the operating cycle of the internal combustion engine or adversely affecting the operation of the internal combustion engine.

One development of the invention provides that the supplying of the fuel injection valve with the second current intensity is performed in such a way that a valve needle is moved out of its closed position in order to at least partially clear the fuel flow connection. If the valve needle is in its closed position, the fuel flow connection through the fuel injection valve is therefore interrupted and the throughflow cross section is therefore equal to zero. The further the valve needle is moved out of the closed position in the direction of an open position, the larger the throughflow cross section, and the fuel flow connection is at least partially cleared in this case.

Of course, there is then the possibility of supplying the fuel injection valve with the second current intensity with such a short duration that the valve needle stays in the closed position, in particular owing to its mass inertia. However, this usually does not bring about the desired "shaking free". In this respect, the supplying is performed, in particular the period of time for which the supplying is performed is selected, in such a way that the valve needle is moved out of the closed position in the direction of the open position, preferably into this open position. The open position describes here a position of the valve needle in which the fuel flow connection is completely cleared and the throughflow cross section is therefore at a maximum.

One preferred refinement of the invention provides that during the clearing operating mode the fuel injection valve is supplied with the second current intensity at least once, in particular repeatedly, over a specific period of time. The supplying process causes, in particular, the valve needle to be moved, which leads to the desired "shaking free". A repeated supplying process is particularly preferred, wherein the time periods in which the supplying process takes place are spaced apart from one another chronologically. This spacing apart is preferably selected here in such a way that after the fuel injection valve has been supplied with the specific current intensity it is reset, and the valve needle therefore moves completely into its closed position again, for example owing to a spring force effect, before the next process of supplying the fuel injection valve is performed over the next specific time period.

One preferred refinement of the invention provides that the clearing operating mode is carried out when an activation signal which is directed to activating the internal combustion engine occurs. After the activation signal, the internal combustion engine is activated, in particular therefore the fuel is placed at the fuel operating pressure and the combustion in the combustion chamber is initiated or carried out. There is then provision that before these measures the clearing operating mode is carried out over a specific clearing operating mode time period. This corresponds essentially to the embodiment already described above, according to which the clearing operating mode is to be performed before the normal operating mode, wherein the internal combustion engine is still deactivated during the clearing operating mode. For example, the clearing operating mode is carried out immediately after the occurrence of the activation signal, and the activation of the internal combustion engine is carried out immediately after the clearing operating mode.

In this context there may be provision, in particular, that the clearing operating mode is carried out before a fuel operating pressure is built up. Details of this have already been given above. However, in one alternative refinement there may also be provision that in the clearing operating mode the fuel injection valve is supplied with a fuel pressure which corresponds to the fuel operating pressure. In such an embodiment, the clearing operating mode is therefore carried out while the internal combustion engine is already activated, in particular the fuel is therefore present at the fuel operating pressure. In addition, combustion can also already be initiated or be carried out in the combustion chamber of the internal combustion engine.

In such an embodiment, the supplying of the fuel injection valve with the second current intensity must be performed in accordance with an operating cycle of the internal combustion engine in order to avoid adversely affecting its operation. In particular, despite the relatively high second current intensity instead of the first current intensity, the quantity of fuel which is required to implement the desired operating point must be introduced into the combustion chamber. For this purpose, it may be necessary, under certain circumstances, to adapt the time period of the supplying process compared to the time period used during the normal operating mode.

One development of the invention provides that the second current intensity is selected to be constant during the clearing operating mode. There is therefore not provision to vary the second current intensity during the clearing operating mode. This is the case, in particular, when the fuel injection valve is triggered by means of pulse-width modulation, wherein the maximum value of the current intensity for this pulse-width modulation corresponds to the first current intensity in the normal operating mode and to the second current intensity in the clearing operating mode.

Finally, there can be provision that a common rail injector is used as the fuel injection valve. Such injectors particularly frequently have the constriction mentioned at the beginning, for example in the form of a gap or the like. The method is therefore particularly preferably used here.

The invention also relates to an internal combustion engine for carrying out the method described above, comprising at least one fuel injection valve for introducing fuel into a combustion chamber of the internal combustion engine, which valve can be supplied with a specific current intensity in order to set a specific throughflow cross section of a fuel flow connection into the combustion chamber. There is provision here that a control device of the internal combustion engine is designed to select the specific current intensity to be at maximum equal to a first current intensity during a normal operating mode of the internal combustion engine and equal to a second, relatively high current intensity during a clearing operating mode.

Advantages of such a refinement of the internal combustion engine or of such a procedure have already been described. The internal combustion engine and the corresponding method can be developed according to the embodiments above, so that reference is made thereto in this respect.

The invention is explained in more detail below with reference to the exemplary embodiments illustrated in the drawing. In this context

BRIEF DESCRIPTION OF THE DRAWING

The single FIGURE shows a diagram in which the current intensity which is present at a fuel injection valve of an internal combustion engine is plotted over time.

DETAILED DESCRIPTION OF THE INVENTION

The single profile which is illustrated in the diagram of the FIGURE shows the profile of a current intensity of the electric current flowing through a fuel injection valve of an internal combustion engine. The fuel injection valve serves to introduce fuel into a combustion chamber of the internal combustion engine. For this purpose, it has a fuel flow connection into the combustion chamber, the throughflow cross section of which fuel flow connection is set by supplying the fuel injection valve with a specific current intensity over a specific duration. In this context, the internal combustion engine can be operated in at least two different operating modes, specifically a normal operating mode and a clearing operating mode. During the normal operating mode, the specific current intensity with which the fuel injection valve is supplied is selected to be at maximum equal to a first current intensity. In contrast, in the clearing operating mode a second current intensity, which is higher than the first current intensity, is to be used for the specific current intensity.

In the clearing operating mode, the fuel injection valve is supplied at least once, but preferably repeatedly, with the second current intensity, in each case over a specific time period. In the exemplary embodiment illustrated here, the clearing operating mode is performed over a clearing operating mode time period $\Delta t_F$. During the latter, the fuel injection valve is supplied with the second current intensity $I_2$ during four time periods $\Delta t_{F1}$, $\Delta t_{F2}$, $\Delta t_{F3}$ and $\Delta t_{F4}$. The second current intensity which is used during each time period $\Delta t_{F1}$, $\Delta t_{F2}$, $\Delta t_{F3}$ and $\Delta t_{F4}$ corresponds, for example, to the respectively highest current intensity occurring in these time periods $\Delta t_{F1}$, $\Delta t_{F2}$, $\Delta t_{F3}$ and $\Delta t_{F4}$. The clearing operating mode time period $\Delta t_{F4}$ occurs here before a time $t_0$ at which the internal combustion engine is activated. Starting from this time $t_0$, the normal operating mode of the internal combustion engine is carried out. This is apparent, in particular, from the fact that the supplying of the fuel injection valve with the first current intensity $I_1$, which is lower than the second current intensity $I_2$, follows the clearing operating time period $\Delta t_F$.

The invention claimed is:

1. A method for operating an internal combustion engine comprising at least one fuel injection valve for introducing fuel into a combustion chamber of the internal combustion engine, the method comprising:

supplying the valve with a specific current intensity using pulse width modulation in order to set a specific throughflow cross section of a fuel flow connection into the combustion chamber, setting the specific current intensity to be equal to a first current intensity during a normal operating mode of the internal combustion engine and setting the specific current intensity to be equal to a second current intensity during a clearing operating mode, wherein the second specific current intensity is higher than the first specific current intensity, and the specific throughflow cross section is set at a maximum during the clearing operating mode, and the specific throughflow cross section is set to less than the maximum during the normal operating mode.

2. The method as claimed in claim 1, including carrying out the clearing operating mode before the normal operating mode.

3. The method as claimed in claim 2, including carrying out the clearing operating mode when the internal combustion engine is deactivated.

4. The method as claimed in claim 1, including performing the supplying of the fuel injection valve with the second current intensity so that a valve needle is moved out of a closed position in order to at least partially clear the fuel flow connection.

5. The method as claimed in claim 1, including supplying the fuel injection valve with the second current intensity at least once over a specific period of time during the clearing operating mode.

6. The method as claimed in claim 5, including supplying the fuel injection valve with the second current intensity repeatedly over the specific period of time.

7. The method as claimed in claim 1, including carrying out the clearing operating mode when an activation signal which is directed to activating the internal combustion engine occurs.

8. The method as claimed in claim 1, including carrying out the clearing operating mode before a fuel operating pressure is built up.

9. The method as claimed in claim 1, wherein in the clearing operating mode the fuel injection valve is supplied with a fuel pressure which corresponds to a fuel operating pressure.

10. The method as claimed in claim 1, including selecting the second current intensity to be constant during the clearing operating mode.

11. The method as claimed in claim 1, wherein a common rail injector is used as the fuel injection valve.

12. An internal combustion engine for carrying out the method as claimed in claim 1, comprising:

a combustion chamber;

at least one fuel injection valve for introducing fuel into the combustion chamber, the fuel injection valve being supplied with a specific current intensity using pulse width modulation in order to set a specific throughflow cross section of a fuel flow connection into the combustion chamber; and a control device designed to select the specific current intensity to be equal to a first current intensity during a normal operating mode of the internal combustion engine and equal to a second current intensity during a clearing operating mode, wherein the second specific current intensity is higher than the first specific current intensity, and wherein the specific throughflow cross section is set at a maximum during the clearing operating mode, and the specific throughflow cross section is set to less than the maximum during the normal operating mode.

* * * * *